US006490542B2

(12) United States Patent
Boehm

(10) Patent No.: US 6,490,542 B2
(45) **Date of Patent: *Dec. 3, 2002**

(54) METHOD FOR MATCHING GOLFERS WITH A DRIVER AND BALL

(75) Inventor: Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/122,334

(22) Filed: Apr. 16, 2002

(65) Prior Publication Data

US 2002/0156598 A1 Oct. 24, 2002

Related U.S. Application Data

(63) Continuation-in-part of application No. 09/775,543, filed on Feb. 5, 2001, now Pat. No. 6,385,559, which is a continuation-in-part of application No. 09/316,365, filed on May 21, 1999, now Pat. No. 6,192,323.

(51) Int. Cl.[7] ..... G06F 11/30
(52) U.S. Cl. ..... 702/182
(58) Field of Search ..... 702/182; 473/223, 473/283, 374, 377, 354, 365, 370, 371

(56) References Cited

U.S. PATENT DOCUMENTS

| | | | | |
|---|---|---|---|---|
| 4,063,259 A | | 12/1977 | Lynch et al. | 354/120 |
| 4,136,387 A | | 1/1979 | Sullivan et al. | 364/410 |
| 4,137,566 A | | 1/1979 | Haas et al. | 364/410 |
| 4,158,853 A | | 6/1979 | Sullivan et al. | 358/93 |
| 4,375,887 A | | 3/1983 | Lynch et al. | 273/32 H |
| 5,694,340 A | | 12/1997 | Kim | 702/141 |
| 5,846,141 A | * | 12/1998 | Morgan et al. | 473/354 |
| 6,354,966 B1 | * | 3/2002 | Takemura et al. | 473/370 |

OTHER PUBLICATIONS

Science Eye: A System for Computer Age Golf Clinics and Custom Golf Club Fitting, Bridgestone Corp., Tokyo, Japan, 6 pages (undated).
DeadSolid Golf brochure, DeadSolid Simulations, Inc., Pittston, PA, 12 pages (undated).
Par T Golf Double Eagle 2000 brochure, Par T Golf Marketing Co., Las Vegas, NV, 6 pages (undated).
Golf Digest Special Editorial Report, 7 pages (Oct. 1980).
Golf Club Design, Fitting, Alteration and Repair: The Principles and Procedures, Ralph Maltby, cover sheet, pp. 310–324 and pp. 481–494 (May 1982).
Maltby, R., *The Golf Works*, "The Complete Golf Club Fitting Plan", Ralph Maltby Enterprises, Inc., Newark, OH, 26 pages (May 1986).
Top–Flite Golf Ball Ad, 1 page (1998).
GolfTek brochure, GolfTek, Lewiston, ID, 6 pages (1998).

* cited by examiner

*Primary Examiner*—Kamini Shah
(74) *Attorney, Agent, or Firm*—Swidler Berlin Shereff Friedman, LLP

(57) ABSTRACT

A simplified method of matching a golfer to a golf club and a golf ball by measuring the golfer's clubhead speed and comparing that measured value to recorded sets of data which correlates a few key variables that can accurately match the golfer with the most suitable golf club and golf ball designed to achieve optimum driving performance.

19 Claims, 5 Drawing Sheets

METHOD FOR MATCHING GOLFERS WITH A DRIVER AND BALL

CROSS-REFERENCE TO RELATED APPLICATIONS

This application is a continuation-in-part of application Ser. No. 09/775,543, filed Feb. 5, 2001, which is a continuation-in-part of copending application Ser. No. 09/316,365, filed May 21, 1999, now U.S. Pat. No. 6,192,323, all of which are incorporated herein by reference in their entireties.

FIELD OF THE INVENTION

The present invention generally relates to methods for custom fitting a golfer with golfing equipment suited to that golfer's individual swing characteristics. More specifically, the present invention relates to a simplified method of matching a golfer with a particular driver and golf ball designed to achieve maximum driving distance.

BACKGROUND OF THE INVENTION

Methods of custom fitting a golfer to the most suitable golf ball, taking into account different swing characteristics, are well known within the golf industry. For example, the testing laboratory at the Acushnet Golf Center in New Bedford, Mass. has been measuring and analyzing the swing characteristics and ball launch conditions of thousands of golfers since the early seventies, as described in a special editorial report in the October 1980 issue of Golf Digest. As a result of this testing, Acushnet has developed an accurate method of matching a golfer with particularized golfing equipment. This method utilizes sophisticated equipment that, while the golfer hits a variety of drivers (or number 1 clubs) having variations in head and shaft characteristics and golf balls of different construction and performance characteristics, measure the ball's launch conditions. Cameras monitor the golfer's launch conditions by tracking the movement of a cluster of light emitting diodes attached to specific locations on the golf ball. Each camera has strobe lights that emit light immediately after the golf ball is struck. The light reflects off the diodes and is captured by the camera and sent to a computer for processing. This data is then recorded and analyzed using complex mathematical models which are able to calculate, among other things, the distance that a golf ball travels when struck off the tee by the golfer. From this information, the most appropriate golf club or golf ball is then selected for that specific golfer. Although this methodology very accurately matches a golfer to a golf club and a golf ball, it requires the use of electronic measuring equipment not always readily available. Consequently, the custom club fitting industry has, in recent years, attempted to meet the need for simpler custom golf club fitting methods.

For example, Spalding has developed the Ball/Club System C and System T which matches Top-Flite golf balls with Callaway's Great Big Bertha and Taylor Made's TI Bubble 2 drivers. These balls were allegedly designed by matching the golf ball to the launch angle, speed and spin for use with the specific drivers. However, the Spalding system fails to consider key variables such as the golfer's swing speed, club loft angles and shaft flex. Therefore, under this system a pro golfer and a beginner using any Callaway club is directed to the same ball. Similarly, Dunlop/Maxfli has proposed a method which matches a players swing speed to a particular ball compression. However, this method fails again to consider the design of the clubhead and the club shaft. Consequently, neither of these methods adequately meets the demand for a simple, yet accurate, club fitting method.

SUMMARY OF THE INVENTION

The present invention achieves both simplicity and accuracy in its disclosed method. Unlike more complex methods, the present invention utilizes only a few key variables out of the many available to match a player to a particular club and a particular ball in a manner that maximizes driving distance.

The key variables, according to the present invention, include the golfer's swing characteristics, the golf club's inertial properties, shaft characteristics and average club face thickness, and the ball's physical properties. According to the present invention, a golf club and a golf ball are selected from a plurality of golf clubs and golf balls by measuring the preferred golfer's swing characteristic and matching that characteristic to key club characteristics and ball characteristics based upon a predetermined relationship as set forth below.

A golfer's swing characteristics can be identified by a number of variables, such as clubhead speed and angle of attack, the direction of the golfer's swing (e.g., inside-out or outside-in), and the acceleration of the clubhead prior to impact. Most preferably, the golfer's swing characteristics are defined simply by the golfer's clubhead speed at impact. Currently, there are many simple, commercially available products that measure a golfer's clubhead speed. Such products range from simple devices that are clipped onto the club shaft and measure clubhead speed using light gates to more complex stand-alone devices that utilize radar. Although the simpler devices do not have a high degree of accuracy, they are accurate enough to classify a golfer within preferred ranges (i.e., high, medium, and low) set forth in the present invention.

The inertial properties and shaft characteristics of a golf club can be characterized by clubhead weight, loft angle, roll, bulge, and center of gravity position, as well as the overall flex, flex point, vibrational frequency, and torsional rigidity of the club shaft. However, in the most preferred embodiment of the invention, the club characteristics are the golf club loft and overall shaft flex for simple club fitting for optimum driving performance.

The physical properties of a golf ball can be characterized by type (i.e. solid or wound construction), size, weight, initial velocity or COR, spin, compression, hardness and moment of inertia. In the most preferred embodiment of the present invention, the two preferred ball characteristics are weight and spin in matching a ball to a particular player.

In all, dozens of variables can be considered when trying to match a golfer to a particular golf club and golf ball to achieve ultimate driving performance. However, the present invention utilizes only a few key variables to create a significantly simplified method that mimics the accuracy of the more complex Acushnet club fitting method described above. Thus, a golfer can be fitted to a club and ball combination from a plurality of clubs and balls so that the golfer's driving performance is optimized. In the preferred embodiment of the invention, the club and ball characteristics are a direct linear relationship to the players swing speed for simple fitting. The use of color coded clubs and balls can be used to simply implement the fitting according to the present invention.

The following definitions apply to the preferred characteristics that are used to select the club and ball for a particular golfer according to the method of the present invention:

a) player characteristics:
- high clubhead speed—greater that about 80 miles per hour,
- medium clubhead speed—greater that about 60 to about 80 miles per hour,
- low clubhead speed—less than about 60 miles per hour;

b) club characteristics:
- club loft—angle between the vertical plane and the face of the club when the shaft is in the vertical plane,
- A shaft flex—Senior flex as determined by weight and shaft deflection,
- R shaft flex—Regular flex as determined by weight and shaft deflection,
- S shaft flex—Stiff flex as determined by weight and shaft deflection,
- XS shaft flex—Extra Stiff flex as determined by weight and shaft deflection;

c) ball characteristics:
- normal ball weight—1.58 to 1.62 oz.,
- light ball weight—1.54 to 1.58 oz.,
- high ball spin—greater than about 3500 revolutions per minute when hit by a True Temper machine under USGA standards,
- medium ball spin—greater than about 3200–3500 revolutions per minute when hit by a True Temper machine under USGA standards,
- low ball spin—less than about 3200 revolutions per minute when hit by a True Temper machine under USGA standards.

DETAILED DESCRIPTION OF THE PREFERRED EMBODIMENT

As stated above, the present invention is directed to a simple and accurate method of fitting a player to a golf club and golf ball. Unlike more complex methods, the present invention utilizes only a few key variables out of the many available to match a player to a particular club and a particular ball in a manner that optimizes driving performance for that player.

In the most preferred embodiment of this invention, the following six variables are selected for use in the fitting method: clubhead speed, club loft angle, club shaft flex, average club face thickness, golf ball weight, and golf ball spin. Thus, in this preferred fitting method according to the present invention, only one variable is specific to the player, only three variables are specific to the golf club, and only two variables are specific to the golf ball. Thus, the method is greatly simplified over prior art methods and accurately fits the golfer.

To maximize driver distance, for example, the ball's launch conditions should be optimized so that the ball has a high initial velocity for the player's clubhead speed, a relatively high launch angle, and a relatively low spin. In this embodiment, the launch angle preferably is greater than 10 degrees, more preferably greater than 12 degrees. It is also preferred that the ball spin be less than 3000 rpm. To achieve these optimum conditions, the golfer's swing characteristics, the golf club's shaft and head physical properties, and the golf ball's physical properties and aerodynamic properties should work together to provide the optimum driver distance.

Figure 1:
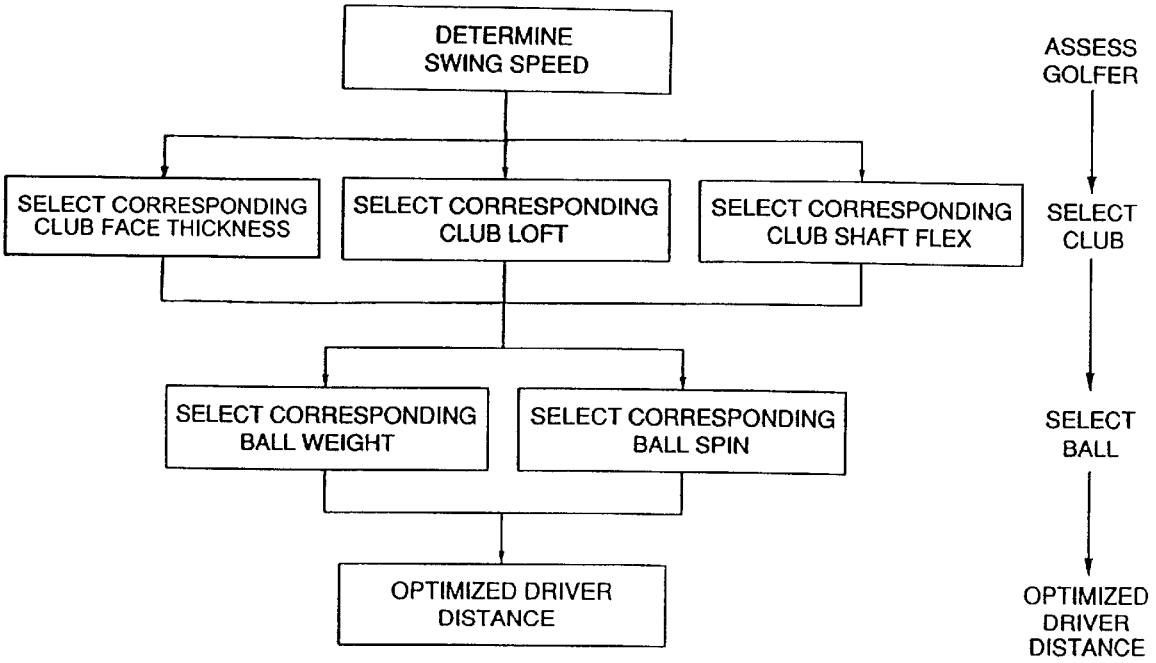
FIG. 1 is a flow chart of the steps involved with fitting a player with a golf club and ball according to the method of the present invention.

As illustrated in FIG. 1, and explained in greater detail below, achieving optimum distance involves three basic steps: (1) assess the golfer's swing characteristics; (2) select the proper club characteristics to suit the golfer's swing; and (3) select the proper ball to match the golfer and club combination. Determining the golfer's swing characteristics allows proper club selection so that club head speed at the time of impact with the ball can be maximized. As explained below, maximizing club head speed is determined by the golfer's swing characteristics, the shaft flex and the inertial properties of the golf club head.

It is preferred that as much energy as possible is transferred from the moving club head to the stationary golf ball, and that the golf ball leaves the face of the club with maximum ball speed at an appropriate launch angle and spin. This transfer of energy is influenced by the coefficient of restitution (COR) between the club and the ball during impact and is a function of the ball mass, club mass, club face thickness, elastic modulus of the club, and resiliency of the ball. The physical properties of the materials comprising both the ball and the club, as well as the thickness and other dimensions of the chosen materials, determine the COR resulting from the club-ball impact.

Ball COR is obtained by dividing a ball's rebound velocity by its initial (i.e., incoming) velocity. In the past, ball COR has been measured at an impact velocity of about 125 feet per second. For further discussion, see commonly assigned U.S. Pat. No. 6,124,389 entitled "MULTILAYER GOLF BALL AND COMPOSITION," which is incorporated herein by reference in its entirety. Under these conditions, most golf balls have a COR in the range of about 0.800 to about 0.820. It should be noted, however, that the COR of a golf ball is a function of the golf ball impact velocity. In general, ball COR tends to decrease as ball impact speed increases. For instance, a golf ball having the COR values noted above at 125 feet per second may have COR values as low as about 0.780 to about 0.790 when measured at an impact velocity of 150 feet per second. A higher COR dissipates a smaller fraction of total energy when the ball collides with and rebounds from the club face, while a lower COR dissipates a larger fraction of energy. It follows that an increase in COR will generally result in an increase in ball flight distance and the maximum total travel distance of the golf ball. Further discussion of methods of measuring ball COR can be found in commonly assigned U.S. patent application Ser. No. 09/955,124 entitled "APPARATUS AND METHOD FOR MEASUREMENT OF COEFFICIENT OF RESTITUTION AND CONTACT TIME," which is incorporated herein by reference in its entirety.

The USGA has established rules and measurement procedures regarding club COR. For instance, Rule 5 in Appendix II prohibits the club face from having the effect at impact of a spring with a golf ball. In 1998, the USGA adopted a test procedure pursuant to Rule 5 which measures club face COR. This USGA test procedure, as well as procedures like it, may be used to measure club face COR.

In general, club COR is discussed in commonly assigned U.S. patent application Ser. No. 09/551,771 entitled "GOLF CLUB HEAD WITH A HIGH COEFFICIENT OF RESTITUTION," which is incorporated herein by reference in its entirety. For golf clubs, it is preferred to have a club COR greater than about 0.800. It is more preferable to have a COR greater than about 0.820. It is still more preferable to have a COR greater than about 0.825. It is noted that the Rules of Golf according to the USGA place a limit on COR, while the Rules of Golf according to the Royal and Ancient Golf Club of St. Andrews, Scotland do not impose such a limitation. It may therefore be possible to obtain a different result depending on which rules are used. For instance, in one embodiment of the present invention, it is preferred that the club have a COR less than the maximum permitted by the USGA Rules. More particularly, the club COR may be less than 0.830.

Thus, COR of the ball and club are additional factors that can be used as parameters for determining the proper ball and club for a particular golfer. Because the COR affects ball flight and total travel distance, this parameter may be used when matching a golfer to a golf ball and a golf club. Thus, COR can be measured for the club alone, the ball alone, and the combination of the club and ball together and considered when selecting a golf club and golf ball. In a preferred embodiment, the combination of club COR and ball COR is maximized.

COR can be used to determine what club and/or ball should be used. For example, suppose a player can choose from a variety of clubs having a COR of 0.80 but having differing loft angles. If the player has a low swing speed, then the player should choose a club having a loft angle of at least about 10.5°. If the player has a medium swing speed, then the player should choose a club having a loft angle of from about 9° to about 11°. If the player has a high swing speed, the player should choose a club having a loft angle from about 6° to about 10°. These results are presented in tabular form below.

| Swing Speed | Club COR | Loft Angle (degrees) |
|---|---|---|
| Low | .80 | 10.5+ |
| Medium | .80 | 9–11 |
| High | .80 | 6–10 |

Figure 5:
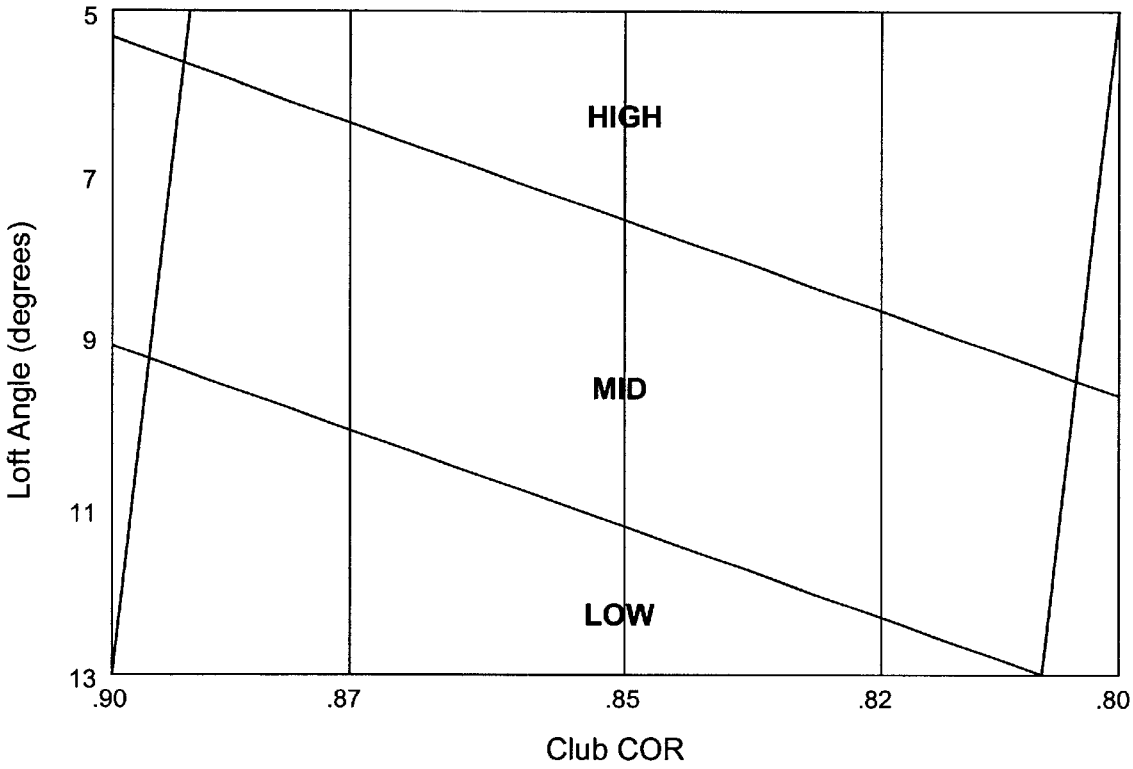
FIG. 5 is another chart correlating club characteristics against golfer swing speed.

FIG. 5 shows similar results over a broader range of COR values. There it is seen that COR can be used in combination with the player's swing speed to determine the proper club. As in the example shown, COR and swing speed can be used to determine the proper loft angle the player should use. First, the desired COR value is determined. This may be determined as described above. After the desired COR is chosen, this predetermined value is matched with the player's swing speed. The values along the vertical axis provide the proper range of loft angles the player should use.

After achieving the optimum energy transfer from club head to ball, it is preferred that the optimum launch angle and ball spin are determined to further achieve maximum distance. The launch angle and ball spin are determined in part from the club head loft angle and the location of the center of gravity of the club head relative to the center of gravity of the ball during impact. Other factors include the aerodynamic properties of the golf ball, such as its coefficients of lift and drag, and other physical properties of the ball. Preferably, all of these factors are considered in order to maximize distance.

The following table shows typical launch conditions for low, medium and high swing speed players versus the optimum conditions for driving performance. It is also shown that significant advances can be obtained by properly fitting a golfer to equipment based on a swing speed measurement.

TABLE 1

| | Typical | | Optimum | | Increase |
|---|---|---|---|---|---|
| Swing Speed | Launch Angle (degrees) | Spin Rate (rpm) | Launch Angle (degrees) | Spin Rate (rpm) | in Drive Distance (yards) |
| Low | 14–16 | 2800–3200 | 25–32 | 2900–3300 | 13–15 |
| Medium | 10–14 | 3300–3500 | 22–28 | 2600–2900 | 12–13 |
| High | 6–10 | 3200–3500 | 15–22 | 2400–2700 | 13–16 |

Since a change in launch conditions can significantly increase driving distance, it is advantageous to measure a player's playing characteristic and select club and ball properties to assist the player's game.

Figure 2:
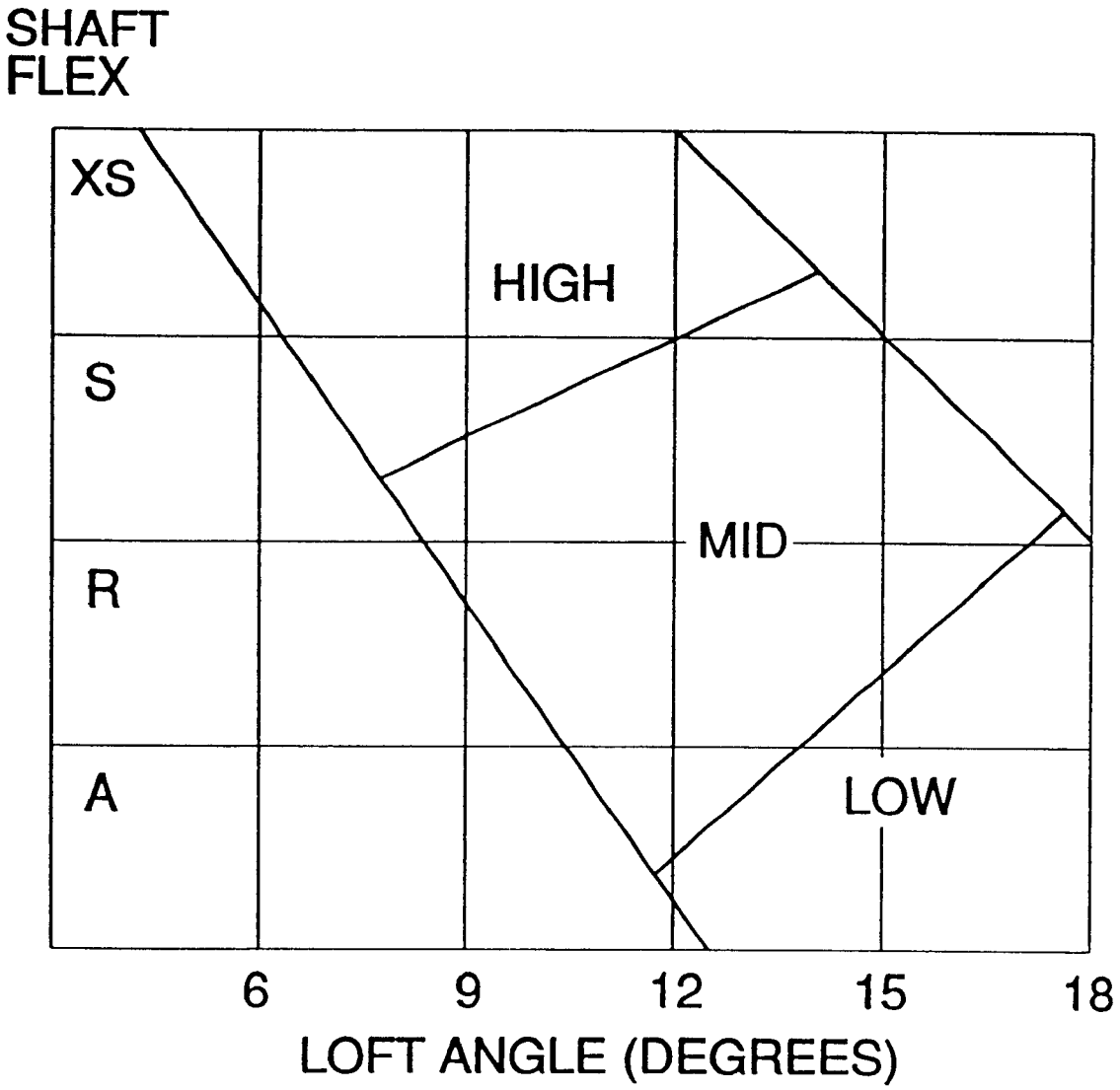
FIG. 2 is a chart correlating club characteristics against golfer swing speed.
Figure 3:
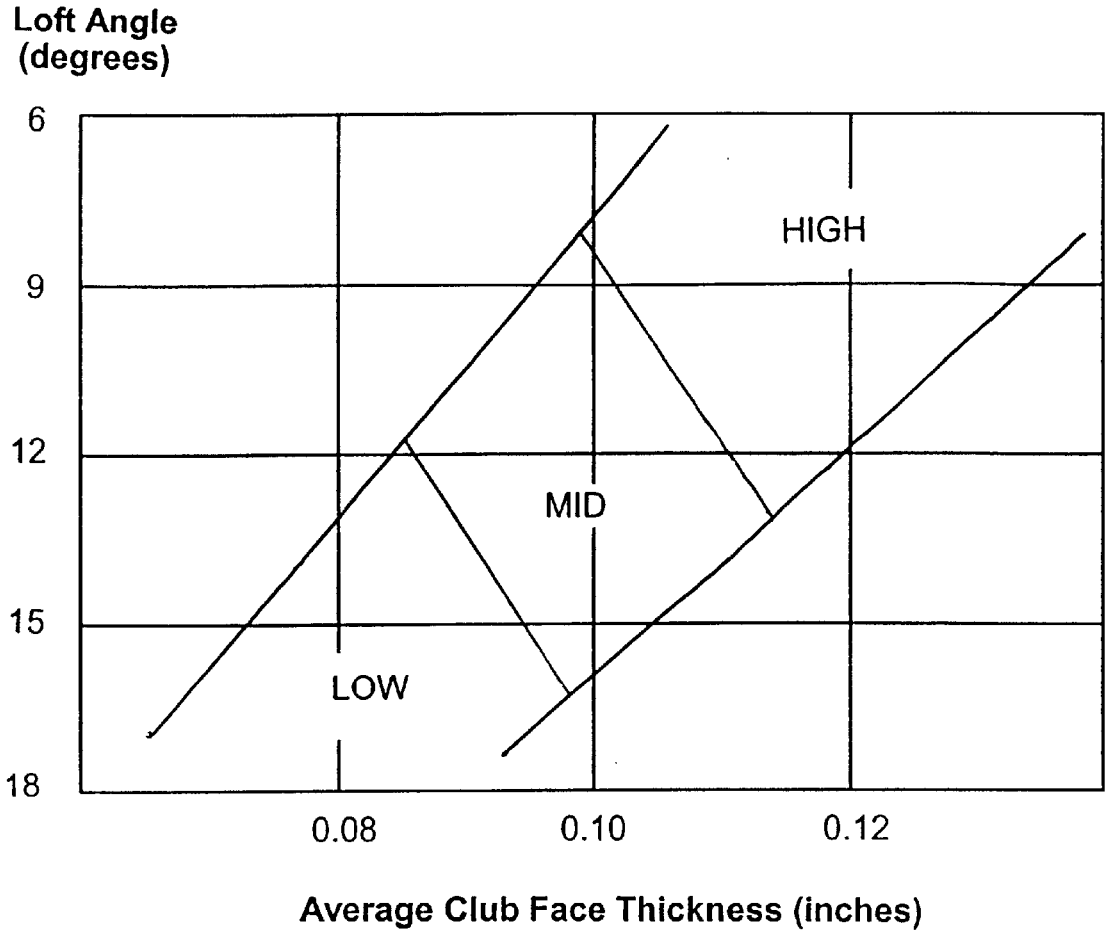
FIG. 3 is another chart correlating club characteristics against golfer swing speed.

Referring to FIG. 1, the method of the present invention is generally as follows. First, a measurement of the golfer's swing characteristic is made. In the most preferred embodiment, the golfer's clubhead speed is taken. Based on the players clubhead speed, the golfer is fitted to the golf club having the proper club characteristics based upon a predetermined relationship between the selected club characteristics and the swing characteristic. Most preferably, the club having the proper loft angle, shaft flex, and club face thickness is selected using a direct linear relationship between these club characteristics and the player's clubhead speed using, for example, the charts in FIGS. 2 and 3. As shown by FIG. 2, the lofts and shaft flexes can be selected by first classifying the golfer into a high, medium or low swing speed using the definitions above or by using a direct relation to the swing speed, preferably within the boundaries set forth in FIG. 2. Likewise, as shown in FIG. 3, the club face thickness and shaft flexes can be further selected according to the player's swing speed, preferably within the boundaries set forth in FIG. 3. Thus, selecting the proper loft angle, shaft flex and face thickness can be achieved by determining the player's club head speed.

Figure 4:
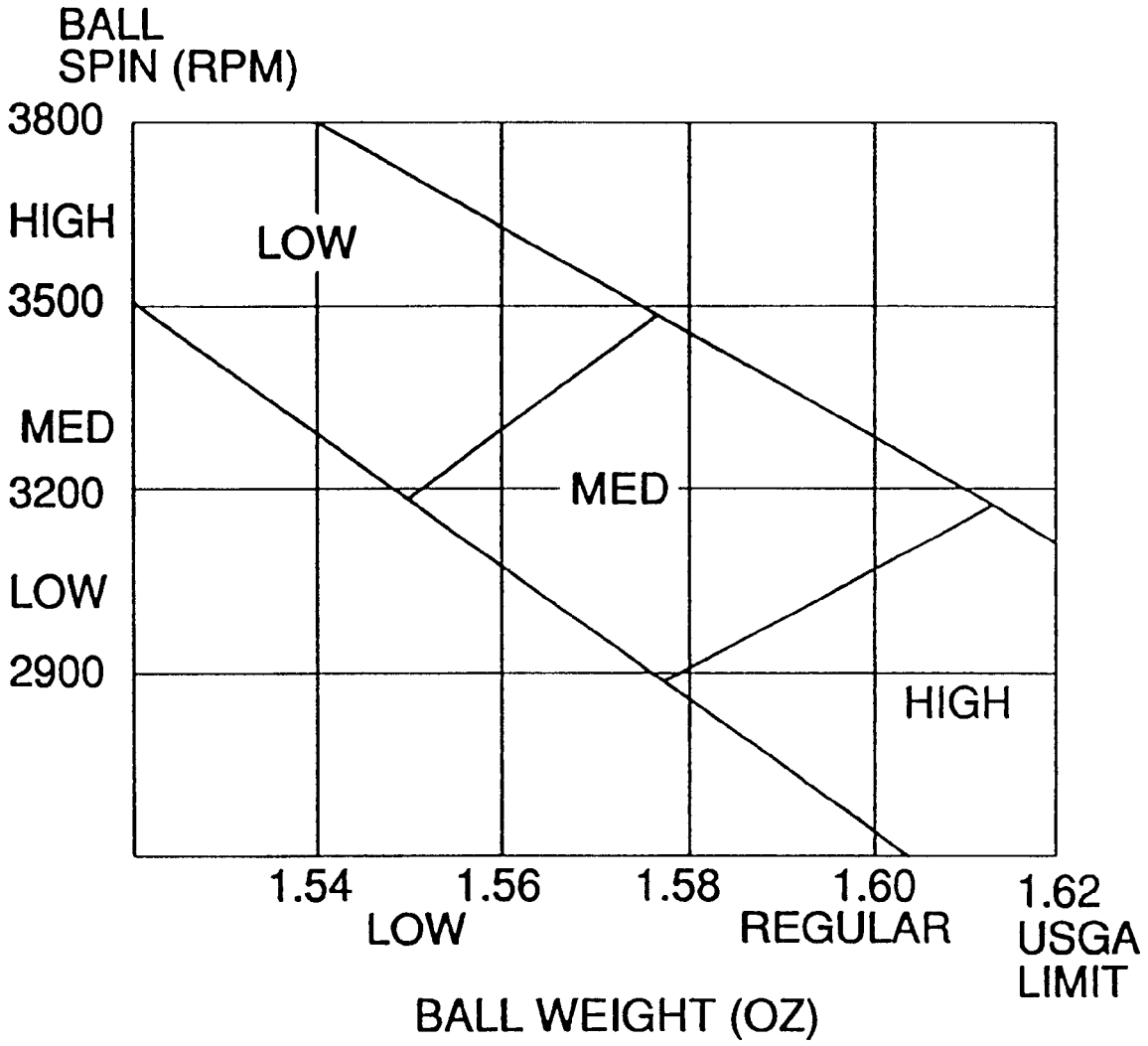
FIG. 4 is a chart correlating golf ball characteristics against swing speed.

After the proper club has been selected, the next step is to select a golf ball based upon a predetermined relationship between the selected golf ball characteristics and the swing characteristic. Most preferably, a ball is selected from a plurality of balls using a direct linear relationship between the ball characteristics and the swing characteristic, for example utilizing the chart set forth in FIG. 4 a golf ball can be selected using a linear relationship between golf ball weight and spin to the player's clubhead speed. The ball can be one of a plurality having a particular weight and/or spin as shown in FIG. 4 or can be classified as regular or low weight and high, medium or low spin as set forth by the definitions above.

The golfer's clubhead speed can be determined using any available device. Preferably, a device such as the Mini-Pro 100 Golf Swing Analyzer, the Pro V Golf Swing Analyzer or the Pro III Golf Swing Analyzer available from Golfrek, 0201 1st street, Lewiston, Id. 83501; the DeadSolid Golf Simulator from DeadSolid Golf, 1192 Sathers Dr., Pittston, Pa. 18640; or the Double Eagle 2000 from Par T Golf, 7310 Smoke Ranch Rd., Suite H, Las Vegas, Nev. 89128 is used to measure the clubhead speed at impact during a golfer's swing. More particularly, the golfer's swing speed is measured using a golf club having a length between 43½ to 46 inches. Most preferably, the golfer's clubhead speed is measured using a club of 44 inches long. The swing speed can then be classified as high, medium or low as set forth by the definitions above.

After the golfer's clubhead speed has been determined, the proper golf club is selected using the predetermined relationship between the club loft angle and the golfer's clubhead speed such as the linear relation set forth in FIG. 2. Preferably, the loft is selected based on the natural loft, i.e., the loft of the wood measured by the angle between the face of the wood, measured at ½ the face height, and the sole of the wood less ninety degrees. The loft of a wood club is measured differently than an iron. Thus, if the present invention is being used to fit an iron, the loft is calculated by measuring the angle between the shaft bore or hosel to the club face. Determining the clubhead of loft woods and irons is well known in the art and is clearly set forth in Ralph Maltby's *Golf Club Design, Fitting, Alteration and Repair,* $2^{nd}$ edition, pg. 310–324. Generally though, the present invention is directed to fitting a golfer to a driver, which generally come in different lofts. Preferably, the clubs are a preselected set of the same driver, e.g., the Titleist Titanium 975D drivers, which come in lofts of 5.5, 6.5, 7.5, 8.5, 9.5, 10.5 and 11.5 degrees. The lofts that are selected will depend on different parameters such as the clubhead size and location of the center of gravity. Generally, the larger the clubhead the less loft is required for a specific hitter because of the increase in dynamic loft. Therefore, the lofts set forth in FIG. 2 are merely representative of the actual set of lofts that may be selected by someone of ordinary skill in the art.

Thus, in the manner of carrying out the present invention set forth above, the golfer's swing speed can be measured and classified as high, medium and low and the appropriate clubhead loft determined based on the preselected loft for the swing speed. In the most preferred embodiment, the golf club loft is selected from a plurality of lofts based on a linear relationship between the golfer's swing speed and the clubhead loft as shown in FIG. 2 for example. The ranges set forth by the two linear boundaries of the fitting parameters are linear fits of golf club characteristics to golfer characteristics and there are many different direct relations that can be chosen based on the manufacturer's desires. As discussed above, different manufacturers will have different sized club heads, different locations for the center of gravity, etc., which will all change the launch condition of a golf ball.

Next, the golf club shaft is selected using a predetermined relationship between the shaft flex and the golfer's swing speed such as the linear relationship set forth in FIG. 2. Preferably, the shaft flex is selected from a group that can comprise of A, R, S and XS as defined above. Preferably, the shaft flex is selected based on the deflection and weight of the shaft. Determining the shaft flex is well know in the art and clearly set forth in Ralph Maltby's *Golf Club Design, Fitting, Alteration and Repair,* $2^{nd}$ edition, pg. 481–494. Generally though, the present invention is directed to fitting a golfer to a driver which generally come in different flexes as set forth by the shaft manufacturer. For example, the following table identifies different shaft flex properties that can be followed.

| Material | Length (inches) | Label | Frequency CPM | Weight (gms) |
|---|---|---|---|---|
| Steel | 43 | Senior | 235 | |
| Steel | 43 | Regular | 250 | 120.5 |
| Steel | 43 | Stiff | 260 | 121.0 |
| Steel | 43 | X-Stiff | 273 | 124.0 |
| Graphite | 43 | Regular | 270 | 92.0 |
| Graphite | 43 | Stiff | 276 | 93.0 |
| Graphite | 43 | X-Stiff | 290 | 93.0 |

The third parameter in club selection is average club face thickness. Club face is the substantially planar surface of the club used to hit the golf ball. The club face can be of uniform thickness or may vary in thickness from location to location. In either case, determining the average club face thickness is accomplished by measuring the club face thickness at various locations and arriving at an average value. In determining what club to select for a particular player, the average club face thickness can be selected according to the player's club head speed. More particularly, the desired average club face thickness for a particular player can be selected from a chart correlating player club head speed with suitable average club face thickness, as illustrated in FIG. 3. As illustrated in FIG. 3, for instance, a player a relatively low club head speed may be matched with a club having an average club face thickness of between about 0.07 to about 0.09 inches. Likewise, a player with an average, or mid-range, club head speed may be matched with a club having an average club face thickness between about 0.09 to about 0.11 inches, and a player with a high swing speed may be matched with a club having an average club face thickness of between about 0.10 to about 0.13 inches. While the average club face thicknesses described above are illustrative, and other ranges corresponding to a players club head speed may be selected without departing from the spirit and scope of the present invention, it is preferred that average club face thickness be sufficiently thick to provide proper durability.

After the proper club has been selected, the next step is to select the proper ball for the player. The two characteristics used in a ball selection are ball weight and ball spin. The golf ball weight is selected using a predetermined relationship between the golf ball weight and the golfer's swing speed such as the linear relationship set forth in FIG. 4. Preferably, the golf ball is selected from low weight balls or regular weight balls as defined above. However, the ball weight can also have a linear relationship with the swing speed directly by providing a plurality of predetermined weights for golf balls such as those set forth in FIG. 4. Generally though, the present invention is directed to fitting a golfer to a ball which generally come in different weights as set forth by the ball manufacturer.

Then the golf ball spin is selected using a predetermined relationship between the golf ball spin and the golfer's swing speed such as the direct relationship set forth in FIG. 4. Preferably, the golf ball is selected from low spin balls, medium spin balls or high spin balls as defined above and as shown in FIG. 4. However, the ball spin can also have a linear relationship with the swing speed directly by providing a plurality of predetermined spin rate balls and matching them to particular swing speeds as shown by the upper and lower boundaries set forth in FIG. 4. Generally though, the present invention is directed to fitting a golfer to a ball which generally comes with different spin rates as set forth by the ball manufacturer and then these are matched to particular swing speed players.

EXAMPLE 1

Consider an average handicap player (i.e., 12–18) with a measured clubhead speed of 80 miles per hour, which would characterize this golfer under the present invention as having a medium swing speed. Now referring to FIG. 2, it can be seen that such a golfer should be matched with a club having a loft angle between 9° and 15° and more preferably to a driver having a loft of about 12°. Moreover, the golfer should be fitted to either a R or S shaft flex to obtain optimum driving performance. Most preferably, the golfer would be fitted to the R shaft flex using FIG. 2. As illustrated in FIG. 3, the average club face thickness corresponding to the player of this example would be about 0.09 to about 0.10 inches.

Once the proper club is selected, the next step is to match the golfer to a desired weight golf ball and a spin rate as set forth in FIG. 4. As shown in FIG. 4, it is preferred that the golfer in this example use a ball having a weight between about 1.56 and 1.61, and a spin rate from about 2900 to about 3400. More particularly, the golfer can be fitted to a ball having a weight of about 1.58 ounces and a spin rate of about 3000 when hit by a True Temper machine under USGA standards. However, it should be noted that for different golf club constructions and different golf ball constructions, these recommended lofts, flexes, ball weights and ball spin rates may vary, as discussed above.

EXAMPLE 2

Now consider a senior golfer whose measured clubhead speed is 55 miles per hour, which is a low clubhead speed under the present invention. Referring to FIG. 2, it can be seen that such a golfer should be matched to a driver with a loft angle between 12° and 18° and either an A or R shaft flex to achieve maximum driving distance. Preferably, the golfer is matched to a 15° driver with a flex as shown by FIG. 2. Then, referring to FIG. 3, the average club face thickness of the club should be between about 0.07 to about 0.08 inches.

Next, the golfer should be matched to a golf ball having a low weight and high spin. More specifically, as shown in FIG. 4, the golfer should use a low weight ball of about 1.56 oz. And have a ball with a spin rate of greater than 3500 rpm when hit with a True Temper machine according to USGA standards.

Although the present invention can be utilized by golfers of any skill level, the most preferred embodiment set forth in detail herein is most appropriate for medium to high handicap golfers. Furthermore, it will be understood that the claims are intended to cover all changes and modifications of the preferred embodiment of the invention, herein chosen for the purpose of illustration, which do not constitute departures from the spirit and scope of the invention.

What is claimed is:

1. A method for matching a golfer to a golf ball and a golf club comprising the steps of:

measuring clubhead speed for the golfer at impact with a ball;

comparing the golfer's measured clubhead speed to predetermined recorded sets of data which interrelates clubhead speed to a set of variables on a predetermined relationship consisting essentially of:

golf club loft angle;

golf club coefficient of restitution;

golf ball weight; and golf ball spin;

matching said golfer to at least one golf club and at least one golf ball in accordance with the comparison of said golfer's clubhead speed to the variables to obtain optimum driving performance.

2. The method of claim 1 wherein said golfer's clubhead speed is interrelated to the golf club loft angle based on a linear relationship.

3. The method of claim 1 wherein said golfer's clubhead speed is interrelated to the golf club coefficient of restitution based on a linear relationship.

4. The method of claim 1 wherein said golfer's clubhead speed is interrelated to the golf ball weight based on a linear relationship.

5. The method of claim 1 wherein said golfer's clubhead speed is interrelated to the golf ball spin based on a linear relationship.

6. The method of claim 1 wherein said golfer's measured clubhead speed is characterized as high, medium, and low, wherein;

said high clubhead speed is a rate greater than about 80 miles per hour;

said medium clubhead speed is a rate between about 60 to about 80 miles per hour; and said low clubhead speed is a rate less than about 60 miles per hour; and wherein the golf club loft, golf club golf club coefficient of restitution, golf ball weight and golf ball spin are selected for the player based on the clubhead speed characterization.

7. The method of claim 1 wherein the at least one golf club and the at least one golf ball is selected to achieve a maximum driving distance.

8. The method of claim 1, wherein the set of variables further includes average golf club face thickness.

9. The method of claim 1, wherein the golf club coefficient of restitution is maximized.

10. A method for matching a golfer to a golf ball and a golf club comprising the steps of:

(a) measuring swing speed for the golfer;

(b) comparing the golfer's swing speed to at least one predetermined club characteristic, including club coefficient of restitution, and at least one predetermined golf ball characteristic, including ball coefficient of restitution; and (c) matching said golfer to at least one golf club and at least one golf ball in accordance with the comparison of said golfer's swing speed to the variables to obtain optimum driving performance.

11. A method for matching a golfer to a golf ball and a golf club comprising the steps of:

measuring clubhead speed for the golfer at impact with a ball;

comparing the golfer's measured clubhead speed to predetermined recorded sets of data which interrelates clubhead speed to a set of variables on a predetermined relationship consisting essentially of:

golf club loft angle;

golf ball coefficient of restitution;

golf ball weight; and golf ball spin;

matching said golfer to at least one golf club and at least one golf ball in accordance with the comparison of said golfer's clubhead speed to the variables to obtain optimum driving performance.

12. The method of claim 11 wherein said golfer's clubhead speed is interrelated to the golf club loft angle based on a linear relationship.

13. The method of claim 11 wherein said golfer's clubhead speed is interrelated to the golf ball coefficient of restitution based on a linear relationship.

14. The method of claim 11 wherein said golfer's clubhead speed is interrelated to the golf ball weight based on a linear relationship.

15. The method of claim 11 wherein said golfer's clubhead speed is interrelated to the golf ball spin based on a linear relationship.

16. The method of claim 11 wherein said golfer's measured clubhead speed is characterized as high, medium, and low, wherein;

said high clubhead speed is a rate greater than about 80 miles per hour;

said medium clubhead speed is a rate between about 60 to about 80 miles per hour; and said low clubhead speed is a rate less than about 60 miles per hour; and wherein the golf club loft, golf club golf ball coefficient of restitution, golf ball weight and golf ball spin are selected for the player based on the clubhead speed characterization.

17. The method of claim 11 wherein the at least one golf club and the at least one golf ball is selected to achieve a maximum driving distance.

18. The method of claim 11, wherein the set of variables further includes average golf club face thickness.

19. The method of claim 11, wherein the golf ball coefficient of restitution is maximized.

* * * * *